US006635973B1

(12) United States Patent
Kagoshima et al.

(10) Patent No.: US 6,635,973 B1
(45) Date of Patent: Oct. 21, 2003

(54) CAPACITOR-EQUIPPED WORKING MACHINE

(75) Inventors: Masayuki Kagoshima, Kobe (JP); Hirokazu Araya, Kobe (JP); Hideki Kinugawa, Hiroshima (JP); Masayuki Komiyama, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/700,730

(22) PCT Filed: Mar. 31, 2000

(86) PCT No.: PCT/JP00/02059

§ 371 (c)(1),
(2), (4) Date: Nov. 30, 2000

(87) PCT Pub. No.: WO00/58568

PCT Pub. Date: May 10, 2000

(30) Foreign Application Priority Data

Mar. 31, 1999 (JP) ..... 11-093164

(51) Int. Cl.[7] ..... B60L 1/00

(52) U.S. Cl. ..... 307/10.1; 307/48; 307/59; 318/139; 320/116

(58) Field of Search ..... 307/10.1, 48, 82, 307/75, 59; 320/116, 127, 128, 134–140; 318/139; 37/443, 348, 466, 905

(56) References Cited

U.S. PATENT DOCUMENTS

| | | | | |
|---|---|---|---|---|
| 2,846,640 A | | 8/1958 | Cherones et al. | |
| 4,066,936 A | * | 1/1978 | Hirota | 318/139 |
| 4,723,107 A | | 2/1988 | Schmid | |
| 5,077,973 A | * | 1/1992 | Suzuki et al. | 60/428 |
| 6,199,307 B1 | * | 3/2001 | Kagoshima et al. | 37/443 |
| 6,342,775 B1 | * | 1/2002 | Sleder, Sr. | 320/116 |
| 6,384,489 B1 | * | 5/2002 | Bluemel et al. | 307/10.1 |

FOREIGN PATENT DOCUMENTS

EP 0 812 965 12/1997

* cited by examiner

*Primary Examiner*—Brian Sircus
*Assistant Examiner*—Robert DeBeradubus
(74) *Attorney, Agent, or Firm*—Oblon, Spivak, McClelland, Maier & Neustadt, P.C.

(57) ABSTRACT

A working machine, such as an excavator, provided with a condenser, capable of satisfying condensing conditions required for various works, while minimizing the condensers and maintaining a light-weight. The working machine includes a generator and at a an electrically-operated actuator for generating power for operating a work member by electric power generated by the generator. Further, as for charging-discharging electric power, a plurality of kinds of condensers are provided, and the condensers used are selectively switched according to power required, work contents, or the like.

8 Claims, 7 Drawing Sheets

CAPACITOR-EQUIPPED WORKING MACHINE

BACKGROUND OF THE INVENTION

1. Field of the Invention

The present invention relates to a working machine such as an excavator for actuating a working member such as a boom making use of electric power generated by a generator.

2. Discussion of the Background

In the past, in a working machine such as a hydraulic excavator, generally, a hydraulic pump is driven by making use of power of an engine mounted for self-traveling, and operating oil discharged out of the hydraulic pump is supplied to hydraulic actuators such as a swing actuator, a boom cylinder, an arm cylinder or the like to thereby drive various parts.

However, in those making use of engine power as described above, noises and exhaust gases generated from the engine adversely influence on the environments around the working field, and therefore, at present, particularly in a city area, work within a tunnel, or work in night receives a remarkable limit.

Recently, therefore, the following working machines have been developed in order to eliminate an evil caused by the operation of the engine.

A) An electrically-operated actuator is operated making use of electric power of a battery mounted on the working machine, and a hydraulic pump is driven by the electrically-operated actuator (for example, see Japanese Patent Application Laid-Open No. Hei 9 (1997)-144061 Publication).

B) There are provided a generator for generating power making use of engine power, and a condenser for suitably charging and discharging overs and shorts of power generated thereby a load of the engine is made constant to reduce consuming fuel of the engine and the quantity of exhaust gases.

However, in the battery driving type working machine in A), there is a disadvantage that as compared with the case where the engine is a power source, operating time is so short that continuous work for a long time cannot be accomplished.

On the other hand, in the so-called hybrid driving type working machine in B), there are problems as noted below.

Taking the excavator as the working machine as an example, this excavator has may working patterns such as excavation, slope finishing, leveling, hardening, scattering, crane traveling, etc. Further, loads (necessary power) greatly differ with each work, and accordingly, condensing ability required for a condenser varies.

For example, in case of excavation work, time for carrying out one operation is short, but operation of each actuator is quick, and acceleration and deceleration are frequently carried out, and therefore a peak value of load and a variation of load are great. Accordingly, a condenser must have the ability for carrying out charging and discharging operations by a large current in a comparatively short period of time. On the other hand, in case of slope finishing work or the like, time for carrying out one operation is long, but a peak value of load and a variation of load are small, and therefore, a condenser must have the ability capable of supplying power to an electrically-operated actuator little by little over a long period of time.

On the other hand, as typical examples known at present as a condenser, secondary batteries and a capacitor shown in the following Table 1 can be mentioned.

TABLE 1

| | Energy Density | Power Density |
|---|---|---|
| Secondary battery (Lead battery) | 35 Wh/kg | 200 W/kg |
| Secondary battery (Nickel hydrogen battery) | 65 Wh/kg | 200 W/kg |
| Capacitor (Electric double layer condenser) | 0.5 Wh/kg | 500 W/kg |

As given in this Table, the secondary batteries such as the lead battery and the nickel hydrogen battery have the characteristics that the energy density (stored energy per unit weight) is high, whereas the life of charge-discharge cycle is short, and the power density (output per unit weight) is low. Conversely, a large capacity capacitor including the electric double layer condenser has the characteristics that the power density (output per unit weight) is high and the life of charge-discharge cycle is long, whereas the energy density (stored energy per unit weight) is low.

Accordingly, where the secondary battery whose energy density is high and power density is low as described above, work for which is required to supply power little by little over a long period of time as in the slope finishing work corresponds to work for which is required a large output in a short period of time as in the excavation work despite even small weight of a condenser will well suffice, the weight of a condenser has to be made large. Conversely, where a large capacity capacitor whose power density is high and energy density is low is used, work for which is required a large output in a short period of time as in the excavation work corresponds to work carried out continuously for a long period of time as in the slope finishing work despite even a small weight of a condenser can correspond sufficiently, and therefore, the weight of a condenser has to be likewise made large.

That is, in the working machines having work which are greatly different in load characteristic from each other, even where either the secondary battery or the capacitor is applied as a condenser, either output of a condenser or stored quantity of energy results in a considerable excessive capacity. Accordingly, the cost is wasteful, and the entire working machine is difficult to be miniaturized and light-weighted.

SUMMARY OF THE INVENTION

In view of the aforementioned situation, with reducing the size and weight of the working machine, it is an object of the present invention to provide a working machine provided with a condenser capable of satisfying the condensing conditions required for various works.

For solving the aforementioned problems, the present invention employed the following constitution.

That is, the present invention provides a working machine comprising a generator, and an electrically-operated actuator in which power for actuating working members is generated by electric power generated by the generator, the working machine comprising a plurality of condensers for carrying out charging of electric power generated by the generator and supplying of electric power to the electrically-operated actuator, and a switching means for selectively switching the condensers used out of these condensers.

It is noted that the "electrically-operated actuator for generating power for operating working members" includes, in addition to those directly connected to the working members to directly drive the working members, those for swing hydraulic pump included in a hydraulic circuit for driving the working members.

According to the aforesaid constitution, a condenser suitable for the load characteristic of an electrically-operated actuator in the work being carried out actually is selected out of a plurality of condensers whereby the individual condenser can satisfy the charge-discharge conditions require by the work without making it large.

For example, if a first condenser and a second condenser which is higher in output per unit weight and is lower in stored energy per unit weight than the first condenser are included, where a variation of load and a peak value of load are low but continuous charge-discharging for a long period of time is required, and where a variation of load and a peak value of load are high and charge-discharging for a short period of time and with a large current is required, the first condenser and the second condenser are selected respectively whereby even the condensers are small in size, the charge-discharging suited to the work can be carried out.

Switching of the condensers may be carried out, for example, in accordance with switching operation of a selective switch by an operator, or may be automatically carried out.

As an example of the latter, preferably, power detection means for detecting total necessary power of the electrically-operated actuator and switching control means for controlling switching of using condensers on the bass of the detected total necessary power are provided. According to this constitution, selection of proper condensers can be automatically done on the basis of power required actually.

More specifically, if a first condenser and a second condenser which is higher in output per unit weight and is lower in stored energy per unit weight than the first condenser are included as the condensers, and said switching control means is constituted such that where the detected total necessary power is within the range of power preset, the first condenser is selected, and where the detected total necessary power is larger than said range of power or smaller than said range of power, the second condenser is selected, then at the time of work for which variation of power is large and charge-discharging by a large current is required, the second condenser suited thereto is automatically selected, and at the time of work for which variation of power is small, the first condenser capable of charge-discharging for a long period of time are automatically selected, respectively.

Further, preferably, an operating member for operating the electrically-operated actuator, work discriminating means for discriminating work contents from the operating state of the operating member, and switching control means for controlling switching of using condensers according to the work contents discriminated are provided. According to this constitution, the actual work contents are discriminated on the basis of the operating contents of the operating member, and the condenser suited to the work contents is automatically selected and switched.

DESCRIPTION OF THE PREFERRED EMBODIMENTS

The preferred embodiments of the present invention will be described hereinafter with reference to the drawings. While in the following embodiments, an example is shown in which the present invention is applied to an excavator for construction provided with a boom 28, an arm 30 and a bucket 32 as shown in FIGS. 1(*a*) and (*b*), it is noted that the present invention relates to a working machine having work members, and can be applied widely to those having a plurality of work contents different in load characteristics.

1) First Embodiment (FIGS. 1 to 4)

Figure 1A:
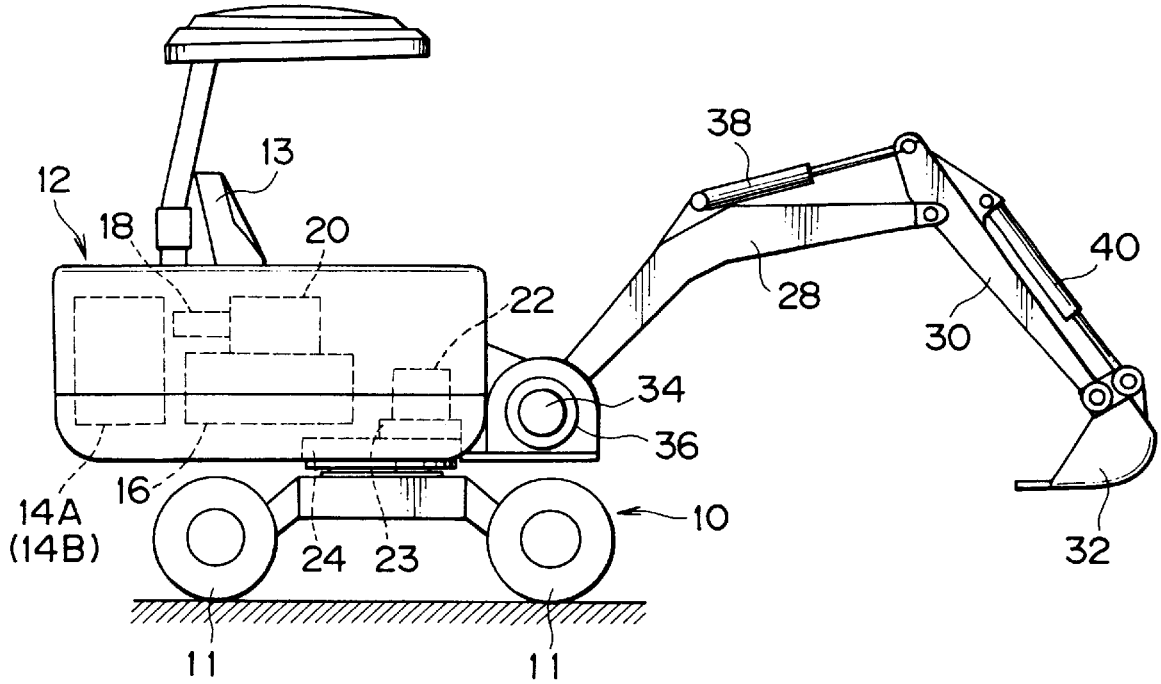
FIG. 1(*a*) is a front view of an excavator according to a first embodiment of the present invention, and FIG. 1(*b*) is a plan view of the excavator.
Figure 1B:
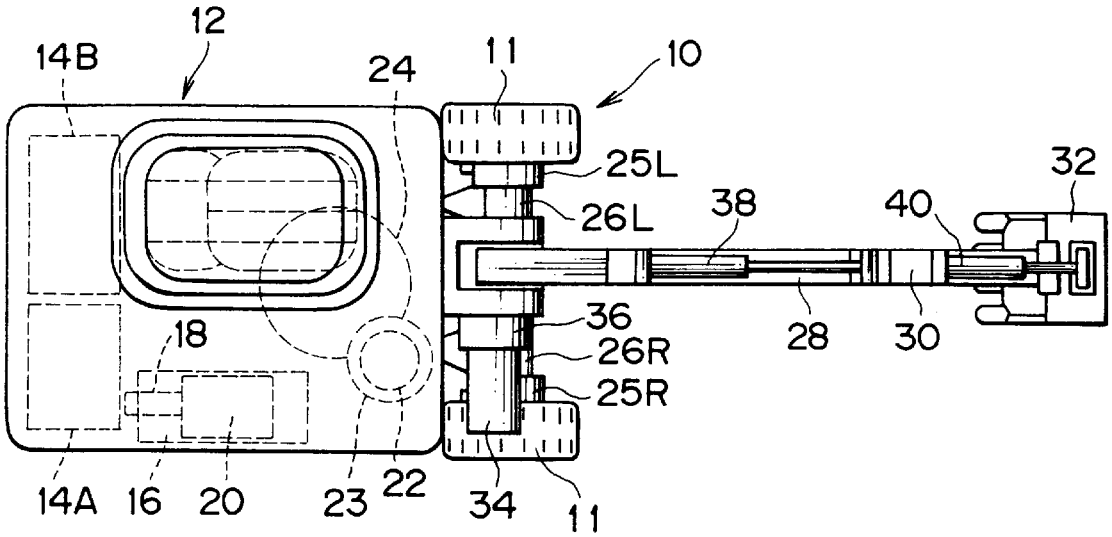

A excavator shown in FIG. 1 is provided with a lower traveling body 10 having a tire 11 for traveling, and an upper rotating body 12 is installed capable of being turned about the vertical axis on the lower traveling body 10. The upper rotating body 12 is provided with a cabin 13, and has a first condenser 14A, a second condenser 14B, a fuel tank 16, a generator 18, an engine 20 and so on mounted thereon.

Figure 2:
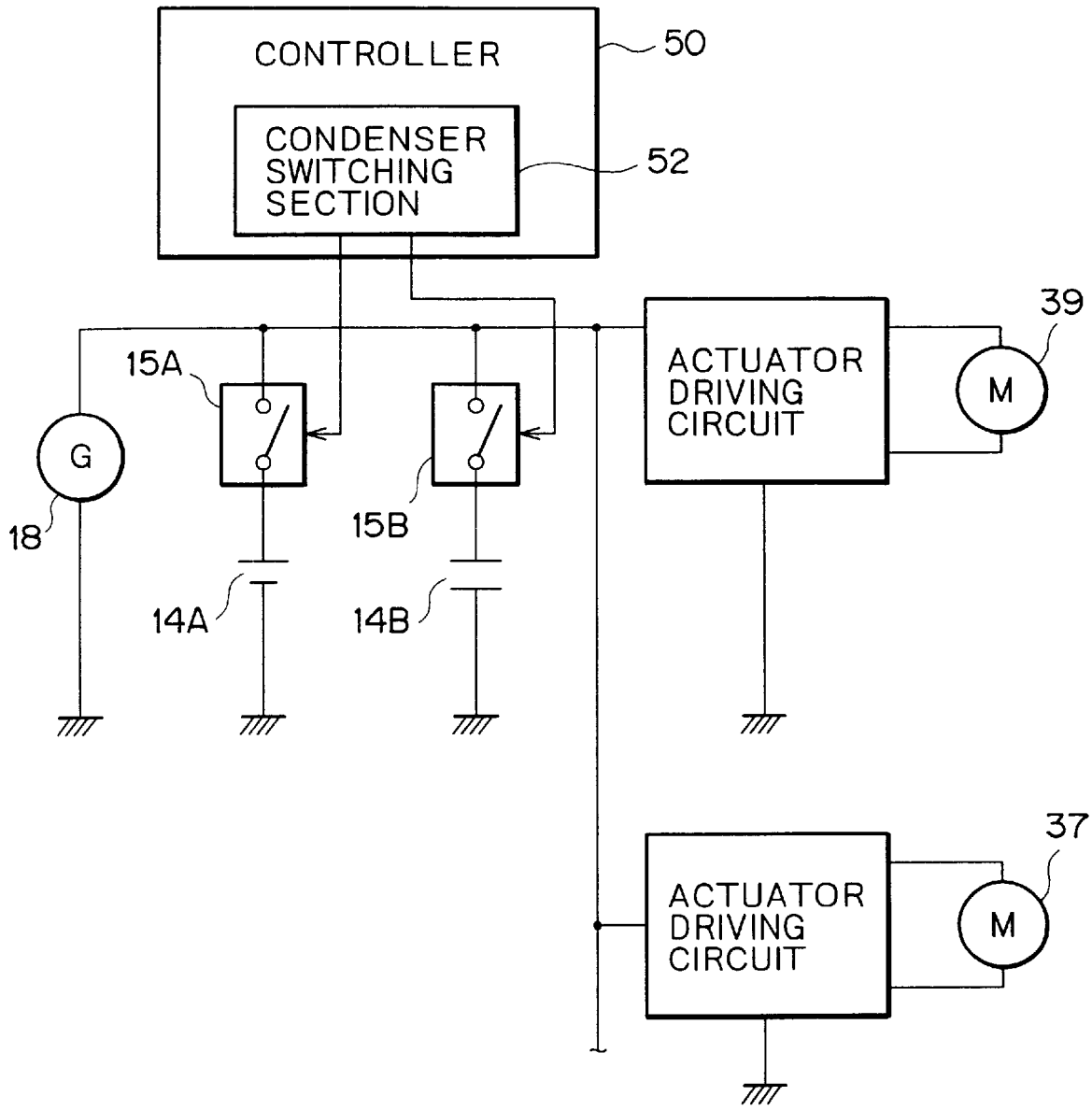
FIG. 2 is a view showing a switching circuit of condensers in the excavator.

The generator 18 is provided to convert output of the engine 20 into electric energy to supply it to a driving circuit of electrically-operated actuators (described in detail later) as shown in FIG. 2.

The first condenser 14A and the second condenser 14B are provided to suitably store a surplus part of electric power generated by the generator 18 to suitably release a short part and supply it the actuator driving circuits. In this embodiment, release switches (switching means) 15A, 15B as shown in FIG. 2 are individually interposed between the generator 18 and the actuator driving circuits, and the condensers 14A, 14B, and either one contact of the release switches 15A, 15B is closed whereby the condensers to be used can be selectively switched.

The first condenser 14A is constituted, for example, like a secondary battery, by a condenser whose power density (output per unit weight) is relatively low and energy density (stored energy per unit weight) is high. On the other hand, the second condenser 14B is constituted, for example, like a large capacity capacitor, by a condenser whose power density is higher than the first condenser 14A and energy density is lower.

Figure 3:
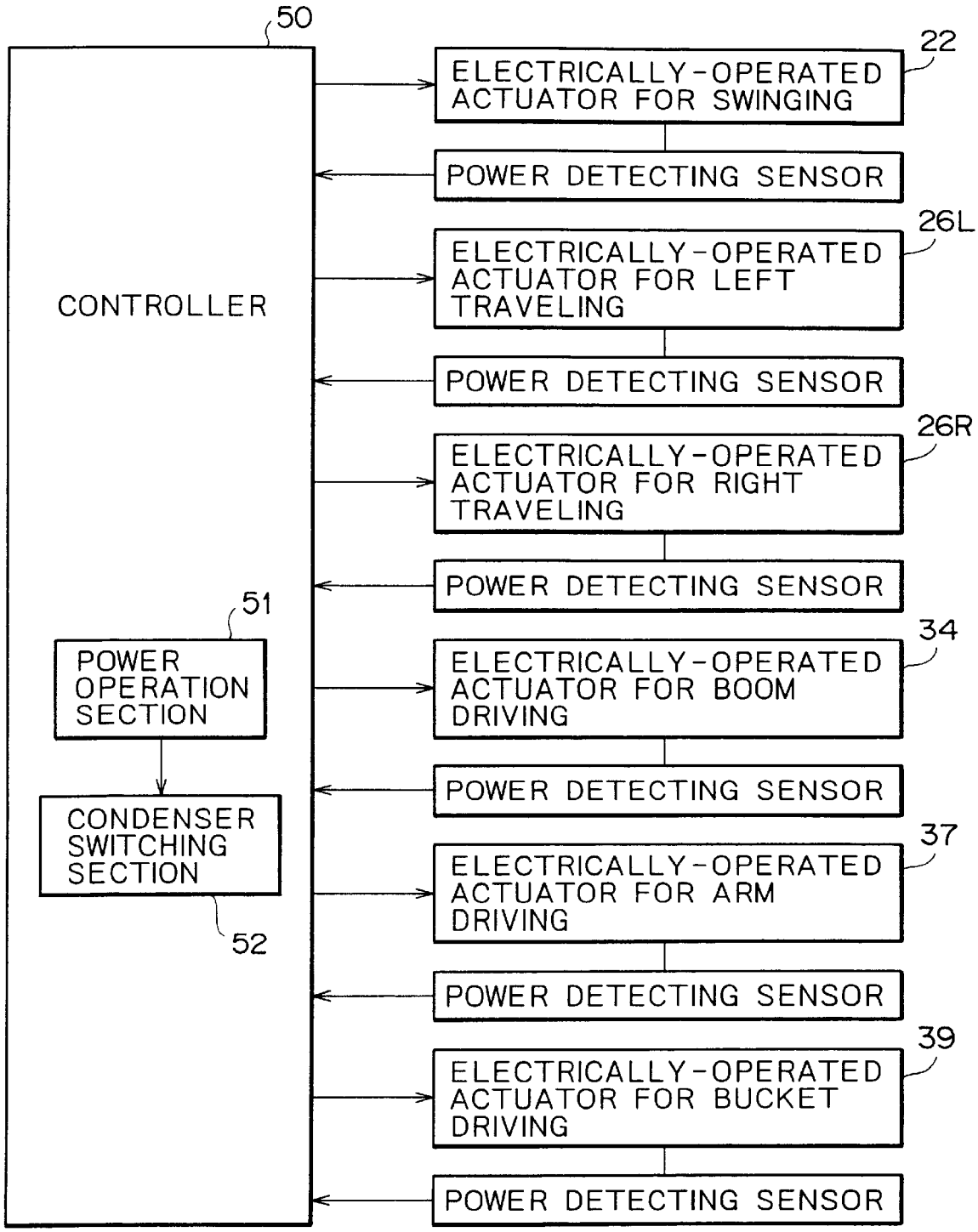
FIG. 3 is a functional block diagram of a controller mounted on the excavator.

This excavator is provided, as the electrically-operated actuators, as shown in FIG. 3, with an electrically-operated actuator for swinging 22, an electrically-operated actuator for left traveling 26L, an electrically-operated actuator for right traveling 26R, an electrically-operated actuator for boom driving 34, an electrically-operated actuator for arm driving 37, and an electrically-operated actuator for bucket driving 39, these actuators being constituted by electric motors in this embodiment.

The electrically-operated actuator for swing and driving 22 is connected to a swinging mechanism 24 through a reduction unit 23, and by the operation of the electrically-operated actuator 22, swinging of the entire upper rotating body 12 is carried out. The electrically-operated actuator for left traveling 26L, and the electrically-operated actuator for right traveling 26R are respectively connected to the front left and right tires 11 through a left reduction unit 25L and a right reduction unit 25R, and by the operation of these electrically-operated actuators 26L, 26R, the entire hydraulic excavator is traveled.

The electrically-operated actuator for boom driving 34 is provided so that by the operation thereof, the boom 28 mounted on the front end of the upper rotating body 12 is turned and driven (risen and fallen movement) about the axis in the width direction. The electrically-operated actuator for arm driving 37 is provided so that by the operation thereof, a hydraulic pump of an arm cylinder driving hydraulic circuit not shown is operated whereby an arm cylinder 38 is expanded and contracted to turn an arm 30 mounted on the extreme end of the boom 28 about the axis in the width direction. Likewise, the electrically-operated actuator for bucket driving 39 is provided so that by the operation thereof, a hydraulic pump of a bucket cylinder driving hydraulic circuit not shown is operated whereby a bucket cylinder 40 is expanded and contracted to turn a bucket 32 mounted on the extreme end of the arm 30 about the axis in the width direction.

Alternatively, the electrically-operated actuator for boom driving 34 is not only directly connected to the boom 28 to directly drive it but also drives a hydraulic pump of a boom driving hydraulic circuit to indirectly drive the boom, similarly to the electrically-operated actuator for arm driving 37. Conversely, the electrically-operated actuator for arm driving 37 and the electrically-operated actuator for bucket driving 39 may be directly connected to the arm 30 and the bucket 32 to directly drive them.

Figure 4:
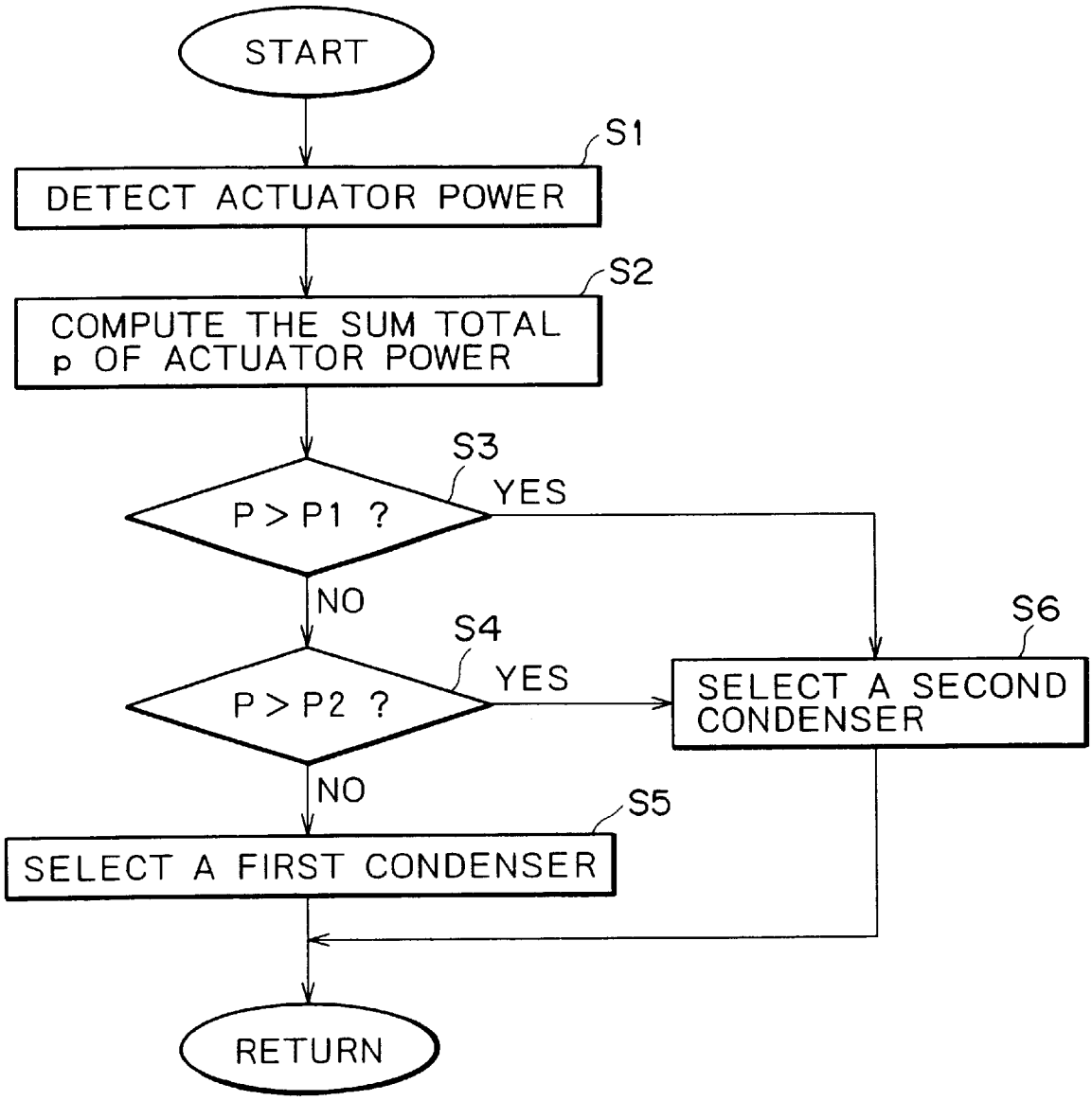
FIG. 4 is a flow chart showing control operation carried out by the controller.

Power detecting sensors as shown in FIG. 3 are individually provided on the electrically-driven actuators so that power (motor load) of the electrically-driven actuators are individually detected by the sensors (Step S1 in FIG. 4). These power detecting sensors may be of voltage sensors for detecting an electrical load of a motor or a current sensor, or may be torque sensors for detecting a mechanical load of a motor or angular velocity sensors.

A detection signal of the power detecting sensors is input into a controller 50 shown in FIG. 3. The controller 50 is constituted by a microcomputer or the like to carry out the start of the engine and the driving control of the electrically-operated actuators and to carry out the switching control of the condensers 14A, 14B on the basis of the detection signal of the power detecting sensors, and is provided with a power operation (computing) section 51 and a condenser switching section (switching control means) 52 for the switching control.

The power operation section 51 is provided to operate the sum total P of necessary power for the actuators detected by the power detecting sensors, that is, the total necessary power during working (Step S2 in FIG. 4), to constitute power detection means along with the power detecting sensors.

The condenser switching section 52 selects a condenser to be used out of both the condensers 14A, 14B on the basis of the sum total P of the actuator power operated by the power operation section 51 and outputs a signal to the release switches 15A, 15B (FIG. 2) corresponding to the selected condenser to switch the condenser into a using state.

More specifically, as shown in FIG. 4, the condenser switching section 52 selects where the sum total P of the actuator power is below the preset upper limit value P1 and above the preset lower limit value P2 (NO in Steps S3 and S4), the first condenser 14A (Step S5), and selects, where the sum total P of the actuator power is above the preset upper limit value P1 (YES in Step S3) or below the preset lower limit value P2 (YES in Step S4), the second condenser 14B (Step S6).

The upper limit value P1 is set to a value higher than the power corresponding to electric power generated by the operation of the engine 20 and the generator 18, and the lower limit value P2 is set to a value lower than the power corresponding to electric power generated by the operation of the engine 20 and the generator 18.

Such an excavator is able to obtain the operation and effect as mentioned below.

First, where a load variation and a load peak of the excavator are small and the power sum total P is within a fixed range, that is, where charge-discharging by a large current in a short period of time is not required ($P1 \leqq P \leqq P2$), the first condenser 14A is selected. Since the first condenser 14A is higher in energy density than the second condenser 14B, even if the first condenser 14A is small in size, necessary electric power can be supplied continuously to the electrically-operated actuators during working for a long period of time, for example, such as the slope finishing or finishing with swing.

Conversely, where a load variation and a load peak of the excavator are large and the sum total P of power is deviated from a fixed range, that is, where discharging by a large current is required in a short period of time ($P > P1$) or where a load is very small and charging by a large current is desired in a short period of time ($P < P2$), the second condenser 14B is selected. Since the second condenser 14B is higher in power density than the first condenser 14B, even if the second condenser 14B is small in size, the request that charge-discharging at a large current be desired to be carried out can be fulfilled.

That is, according to the present excavator, the condenser used is switched on the basis of the sum total of actuator power required actually, whereby it is possible to fulfill charge-discharging request for such a work as described while individual condensers are of a light-weight and a small type, in work for a long period of time or in work for a short period of time in which a load variation is large.

Figure 5:
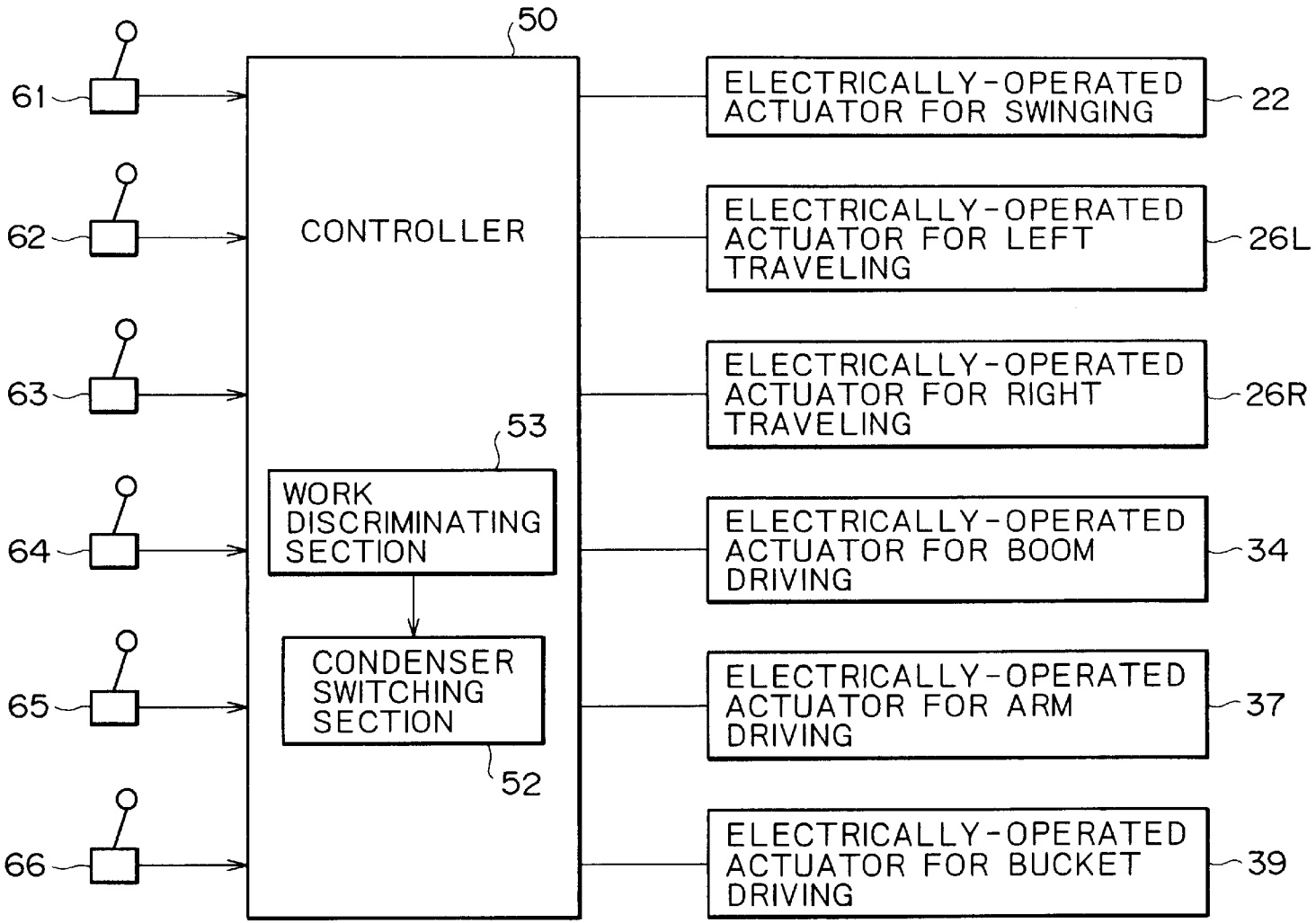
FIG. 5 is a functional block diagram of a controller mounted on the excavator according to a second embodiment.
Figure 6:
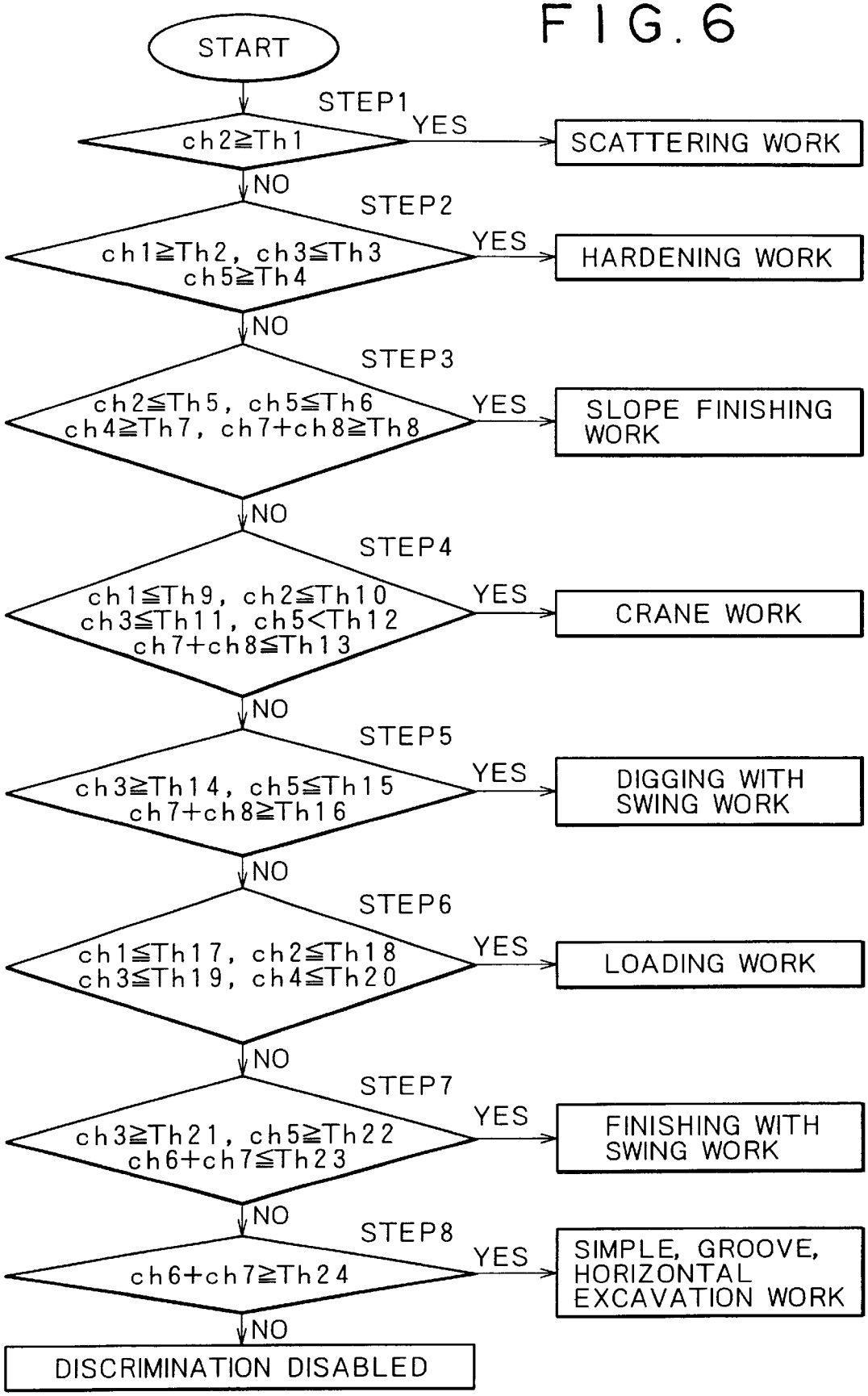
FIG. 6 is a flow chart showing work discriminating operation carried out by the controller shown in FIG. 5.

2) Second Embodiment (FIGS. 5 and 6)

The hardware constitution according to this embodiment is exactly the same as that of the aforementioned first embodiment, and a description thereof is omitted.

In this embodiment, operating levers 61, 62, 63, 64, 65, and 66 for individually operating the electrically-operated actuators 22, 26L, 26R, 34, 37, and 39 are provided in the cabin 13, and an instruction(s) signal produced by operation of the operating levers 61 to 66 is input into a controller 50, and the controller 50 is constituted so that the driving of the electrically-operated actuators is controlled on the basis of the instruction(s) signal, and in addition, the controller 50 is provided with a work discriminating section 53 for discriminating actual work contents on the basis of the instruction(s) signal (operating contents).

To a specific work discriminating procedure according to the work discriminating section 53 can be applied the procedure disclosed, for example, in Japanese Patent Application Laid-Open No. Hei 9 (1997)-217702 Publication, which is summarized as follows:

① Calculation of the Values for Various Discriminations

On the basis of data of operating quantities for a fixed time part of the operating lever for boom 64, a rate in which the operating quantities of the operating lever 64 are varied to be increased and decreased is operated within the fixed time, which is set as the complicatedness display quantity ch1 showing complicatedness of the boom operation. Similarly, on the basis of data of operating quantities for a fixed time part of the operating lever for bucket 66, a rate in which the operating quantities of the operating lever 66 are varied to be increased and decreased is operated within the fixed time, which is set as the complicatedness display quantity ch2 showing complicatedness of the bucket operation.

On the basis of data of operating quantities for the fixed time part of the operating lever for swing 61, a total of the time required till the absolute values of the operating quantities of the operating lever 61 exceeds a predetermined fixed operating quantity is obtained, which is set as the high speed swinging time ch3.

On the basis of data of operating quantities for the fixed time part of the operating levers 64, 65 and 66 for boom, arm and bucket, respective, a total of the time required till the operating quantities of the operating lever for boom 64 exceed a predetermined fixed operating quantity on the positive side in the operating direction (boom up side) within the fixed time, and the operating quantities of the operating lever for arm 65 and the operating lever for bucket 66 are below a predetermined fixed operating quantity on the negative side in the operating direction (drawn side of arm and bucket) is obtained, which is set as the boom reverse operating time ch4.

On the basis of data of operating quantities for the fixed time part of the operating levers 64, 65 and 66 for boom, arm and bucket, respective, a total of the time required till the magnitude (absolute value) of the operating quantities of the operating lever for boom 64 exceed a predetermined fixed operating quantity within the fixed time, and the magnitude of the operating quantities of the operating lever for arm 65 and the operating lever for bucket 66 are below a predetermined fixed operating quantity is obtained, which is set as the bucket-arm stop time ch5.

On the basis of data of operating quantities for the fixed time part of the operating levers 64, 65 and 66 for boom, arm and bucket, respective, the average values of the magnitude of the operating quantities of the operating levers 64, 65, and 66 within the fixed time are individually obtained, which is set as the average value of boom operating quantity ch6, the average value of arm operating quantity ch7, and the average value of bucket operating quantity ch8.

② Work discrimination based on various discriminating values (FIG. 6)

STEP 1: The complicatedness display quantity ch2 of bucket operation is compared with the fixed value Th1 predetermined corresponding thereto. If ch2≧Th1 results, work being done is judged to be scattering work, and in other cases, the step shifts to STEP 2. The "scattering work" termed herein is to repeat, at high speed, work in which by simultaneous operation of the bucket, arm and boom, earth is scooped into the bucket, which is scattered by operation of the bucket.

STEP 2: Where the conditions of STEP 1 are not realized, the boom operation complicatedness display quantity ch1, the high speed swing time ch3, and the bucket/arm stop time ch5 are compared with the fixed values Th2, Th3, and Th4, respectively. If ch1≧Th2, ch3≦Th3, and ch5≧Th4 result, work being done is judged to be "hardening work", and in other cases, the step shifts to STEP 3. The "hardening work" is work in which up-downward movement of the boom is repeated to throw the bucket on the ground many times to harden the ground, the load of the actuator being rapidly increased and decreased shockingly.

STEP 3: Where the conditions of STEP 2 are not realized, the bucket operation complicatedness display quantity ch2, the bucket/arm stop time ch5, the boom reverse operation time ch4, and a total value of the average value of the arm operating quantities and the average value of the boom operating quantities (ch7+ch8) are compared with the predetermined fixed values Th5, Th6, Th7 and Th8, respectively. If ch2≦Th5, ch5≦Th6, and ch4 ≧Th7, and (ch7+ch8)≧Th8 result, work being done is judged to be "slope finishing work", and in other cases, the step shifts to STEP 4. The "slope finishing work" termed herein is work in which by simultaneous operation of the bucket, the arm and the boom, the arm and the boom are operated while placing the bucket along the slanting surface to scrape the slanting surface by the bucket.

STEP 4: Where the conditions of STEP 3 are not realized, the boom operation complicatedness display quantity ch1, the bucket operation complicatedness display quantity ch2, the high speed swing time ch3, the bucket/arm stop time ch5, and a total value of the average value of the arm operating quantities and the average value of the boom operating quantities (ch7+ch8) are compared with the predetermined fixed values Th9, Th1O, Th11, Th12, and Th13, respectively. If ch1≦Th9, ch2≦Th1O, ch3≦Th11, ch5≦Th12, and (ch7+ch8)≦Th13 result, work being done is judged to be "crane work", and in other cases, the step shifts to STEP 5. The "crane work" termed herein is to hang down an article to be carried at the edge of the bucket through a rope or the like to move the article to be carried.

STEP 5: Where the conditions of STEP 4 are not realized, the high speed swing time ch3, the bucket/arm stop time ch5, and a total value of the average value of the arm operating quantities and the average value of the boom operating quantities (ch7+ch8) are compared with the predetermined fixed values Th14, Th15, and Th16, respectively. If ch3≧Th14, ch5≦Th15, and (ch7+ch8)≧Th16 result, work being done is judged to be "digging with swing", and in other cases, the step shifts to STEP 6. The "digging with swing" termed herein is work in which where a groove is dug in the longitudinal direction of the vehicle sideway of the vehicle, the bucket is pressed against the ground while carrying out swing operation to draw it to thereby perform excavation, a variation of load and a load peak of the electrically-operated actuator becoming large.

STEP 6: Where the conditions of STEP 5 are not realized, the boom operation complicatedness display quantity ch1, the bucket operation complicatedness display quantity ch2, the high speed swing time ch3, and the boom reverse operation time ch4 are compared with the predetermined fixed values Th17, Th18, Th19, and Th16, respectively. If ch1≦Th17, ch2≦Th18, ch3≦Th19, and ch4≦Th20 result, work being done is judged to be "loading work", and in other cases, the step shifts to STEP 7. The "loading work" termed herein is work in which when the excavator is transported, the excavator is loaded on a trailer or the like.

STEP 7: Where the conditions of STEP 6 are not realized, the high speed swing time ch3, the bucket/arm stop time ch5, and a total value of the average value of the boom operating quantities and the average value of the arm operating quantities (ch6+ch7) are compared with the predetermined fixed values Th21, Th22, and Th23, respectively. If ch3≧Th21, ch5≧Th22, and (ch6+ch7)≦Th23 result, work being done is judged to be "swing and leveling work", and in other cases, the step shifts to STEP 8. The "swing and leveling work" termed herein is work in which the bucket is placed in contact with the ground, in which state swing operation is done to effect leveling.

STEP 8: Where the conditions of STEP 7 are not realized, a total value of the average value of the boom operating quantities and the average value of the arm operating quantities (ch6+ch7) is compared with the predetermined fixed values Th24. If (ch6+ch7)≧Th24 results, work being done is judged to be excavation work other than said pressing work, that is, "simple excavation, groove excavation, and horizontal excavation work". These work are basically work done by pressing the bucket against the ground at a point forward of the vehicle to draw it this side, and any way, a variation of load and a load peak value of the electrically-operated actuator become large. Where the conditions of STEP 8 are neither realized, work discrimination is disabled.

On the basis of the work contents discriminated as described above, the condenser switching section 52 shown in FIG. 5 carries out selection and switching of condensers used. More specifically, with respect to, out of the above-described work, the hardening, pressing and excavation, simple excavation, grove, and horizontal excavation, in which the work time is relatively short, and the variation of load and the peak value of load are large, the second condenser 14B is selected, and with respect to other work, the first condenser 14A is selected (see TABLE 2).

TABLE 2

| WORK CONTENTS | CONDENSER USED |
|---|---|
| Scattering | First condenser |
| Hardening | Second condenser |
| Normal surface finishing | First condenser |
| Crane | First condenser |
| Pressing and excavation | Second condenser |
| Loading | First condenser |
| Turning and leveling | First condenser |
| Simple excavation, groove, horizontal | First condenser |
| Excavation | Second condenser |

According to such a constitution as described, when work in which the variation of load and peak value of load are large is carried out, the second condenser 14B is selected to thereby carry out charge-discharging by a large current, whereas when work in which the variation of load and peak value of load are small is carried out, the first condenser 14A is selected to thereby carry out work over a long period of time continuously.

It is noted that the work contents to be discriminated are not limited thereto but other work may be added, and conversely the kind of discrimination may be reduced. Further, needless to say, the contents of work to be discriminated are changed according to the kind of working machines.

Figure 7:
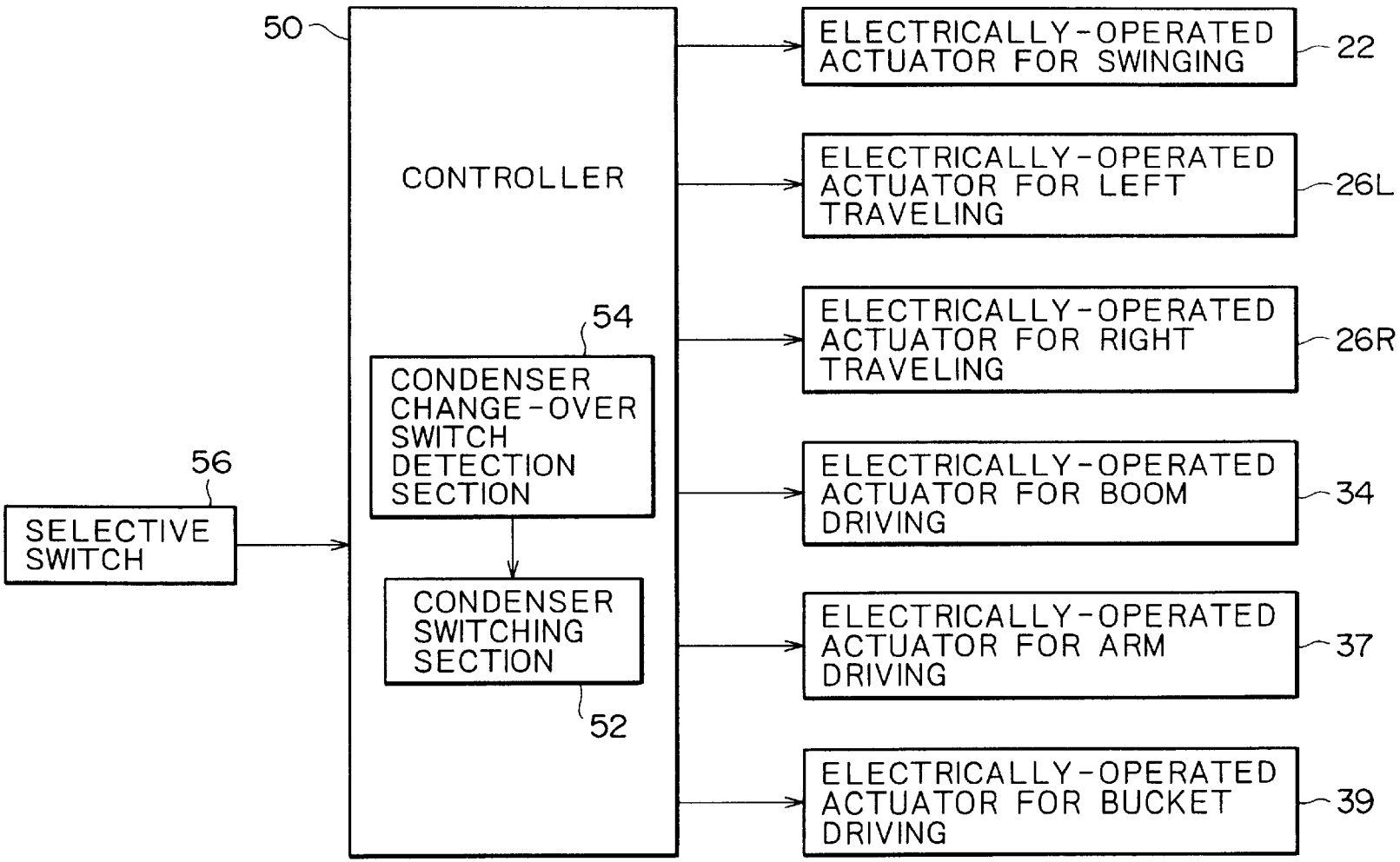
FIG. 7 is a functional block diagram of a controller mounted on the excavator according to a third embodiment of the present invention.

3) Third Embodiment (FIG. 7)

In this embodiment, a selective switch 56 is provided at a suitable location in the vicinity of the cabin 13. The selective switch 56 receives its switching operation to thereby output a selection instruction(s) signal (a signal for selecting the first condenser 14A or a signal for selecting the second condenser 14B) according to the operation thereof The controller 50 is provided with a condenser change-over switch detecting section 54 for receiving the selection instruction(s) signal, and the condenser switching section 52 is constituted so that the condensers used are switched in accordance with the selection instruction(s) signal.

As described above, if the condensers used are selected manually, it is possible to select the condenser suited to the actual work contents by operator's own judgment.

It is noted in this embodiment that switching of the condensers used is not always carried out by an output signal of the controller 50, but for example, an electrical circuit may be constituted such that relay coils of the release switches 15A and 15B shown in FIG. 2 are alternatively energized in association with the operation of the selective switch 56.

Further, in the present invention, the means for switching the condensers used is not limited to the release switch as described, but other switch means may be used.

Moreover, in the present invention, a third and a fourth condensers may be mounted, in addition to the first condenser and the second condenser, so that three condensers or more can be properly used.

INDUSTRIAL APPLICABILITY

As described above, according to the present invention, there can be provided a working machine satisfied with the charging conditions required by the respective work while minimizing and light-weighting the condensers.

What is claimed is:

1. A working machine comprising a generator, and electrically-operated actuators for generating power for operating work members by electric power generated by said generator, said working machine comprising a plurality of capacitors for carrying out charging of electric power generated by said generator and supplying of electric power to said electrically-operated actuators, and switching means for selectively switching a capacitor used out of said plurality of capacitors.

2. The working machine provided with capacitors according to claim 1, wherein said capacitors include a first capacitor, and a second capacitor whose output per unit weight is higher than said first capacitor and stored energy per unit weight is lower than said first capacitor.

3. The working machine provided with capacitors according to claim 2, comprising an operating member for operating said electrically-operated actuators, work discrimination means for discriminating work contents from the operating state of said operating member, and switching control means for controlling switching of capacitors used according to the work contents discriminated.

4. The working machine provided with capacitors according to claim 2, comprising a selective switch for receiving switching operation, switching of capacitors used being carried out corresponding to operation of said selective switch.

5. The working machine provided with capacitors according to claim 1, comprising power detection means for detecting total necessary power of said electrically-operated actuators, and switching control means for controlling switching of the capacitor used on the basis of the detected total necessary power.

6. The working machine provided with capacitors according to claim 5, wherein said capacitors include a first capacitor, and a second capacitor whose output per unit weight is higher than said first capacitor, and stored energy per unit weight is lower than said first capacitor, and said switching control means is constituted such that where the detected total necessary power is within a preset power range, said first capacitor is selected and where the detected total necessary power is larger than said power range or smaller than said power range, said second capacitor is selected.

7. The working machine provided with capacitors according to claim 1, comprising an operating member for operating said electrically-operated actuators, work discrimination means for discriminating work contents from the operating state of said operating member, and switching control means for controlling switching of capacitors used according to the work contents discriminated.

8. The working machine provided with capacitors according to claim 1, comprising a selective switch for receiving switching operation, switching of capacitors used being carried out corresponding to operation of said selective switch.

* * * * *

UNITED STATES PATENT AND TRADEMARK OFFICE

CERTIFICATE OF CORRECTION

PATENT NO. : 6,635,973 B1
DATED : October 21, 2003
INVENTOR(S) : Kagoshima et al.

It is certified that error appears in the above-identified patent and that said Letters Patent is hereby corrected as shown below:

Title page,
Item [87], the PCT information should read:
-- [87] PCT Pub. No.: WO 00/58568
PCT Pub. Date: Oct. 5, 2000 --

Signed and Sealed this

Twentieth Day of January, 2004

JON W. DUDAS
*Acting Director of the United States Patent and Trademark Office*